US007191753B2

(12) United States Patent
Sagara et al.

(10) Patent No.: US 7,191,753 B2
(45) Date of Patent: Mar. 20, 2007

(54) COVER STRUCTURE FOR ENGINE

(75) Inventors: Masashi Sagara, Osaka (JP); Junichi Samo, Osaka (JP); Toshio Kamiyama, Osaka (JP); Shinji Nishimura, Osaka (JP)

(73) Assignee: Yanmar Co., Ltd. (JP)

( * ) Notice: Subject to any disclaimer, the term of this patent is extended or adjusted under 35 U.S.C. 154(b) by 0 days.

(21) Appl. No.: 11/219,912

(22) Filed: Sep. 7, 2005

(65) Prior Publication Data

US 2006/0048742 A1 Mar. 9, 2006

Related U.S. Application Data

(63) Continuation of application No. PCT/JP2004/002091, filed on Feb. 23, 2004.

(30) Foreign Application Priority Data

Mar. 13, 2003 (JP) ..... 2003-068934
Oct. 27, 2003 (JP) ..... 2003-365904

(51) Int. Cl.
*F02B 77/04* (2006.01)

(52) U.S. Cl. ..... 123/198 E; 123/198 R; 181/204

(58) Field of Classification Search ..... 123/198 E, 123/198 R; 181/204
See application file for complete search history.

(56) References Cited

U.S. PATENT DOCUMENTS

| | | | | |
|---|---|---|---|---|
| 3,521,726 | A * | 7/1970 | Freyn | 123/198 E |
| 3,949,727 | A * | 4/1976 | Thien et al. | 123/198 E |
| 4,142,503 | A * | 3/1979 | Hatz et al. | 123/198 E |
| 5,033,578 | A * | 7/1991 | Absenger | 123/198 E |
| 5,161,490 | A * | 11/1992 | Iwata et al. | 123/198 R |

FOREIGN PATENT DOCUMENTS

| | | |
|---|---|---|
| JP | 3 222822 | 10/1991 |
| JP | 4-69648 | 6/1992 |
| JP | 5 34472 | 5/1993 |
| JP | 5-47377 | 6/1993 |
| JP | 8 232654 | 9/1996 |

OTHER PUBLICATIONS

International Search Report for International Application No. PCT/JP2004/002091; Mailed: Jun. 15, 2004.

* cited by examiner

*Primary Examiner*—Noah P. Kamen
(74) *Attorney, Agent, or Firm*—Sterne, Kessler, Goldstein & Fox P.L.L.C.

(57) ABSTRACT

The present invention provides an engine cover structure for an engine (1) whose cylinder head (7) is covered at three of front, rear, right and left sides thereof by a fuel tank (10), an air cleaner (20) and a muffler (9), respectively, comprising a cover (50) which covers the remaining one side and/or a top side of the cylinder head (7).

20 Claims, 13 Drawing Sheets

COVER STRUCTURE FOR ENGINE

CROSS-REFERENCE TO RELATED APPLICATION

The present application is a Continuation of PCT Application No. PCT/JP2004/002091, filed on Feb. 23, 2004, which is incorporated in its entirety herein by reference thereto.

BACKGROUND OF THE INVENTION

1. Field of the Invention

The present invention relates to a structure of an engine cover that covers an upper part of an engine.

2. Background Art

Conventionally, there is a well-known type of engine whose cylinder head is surrounded by devices such as a muffler, a fuel tank and an air cleaner. For example, Japanese Patent Application Publication No. Hei 8-232654 discloses a technique to send cooling air from a fan provided on one side of a cylinder block to the opposite side of the cylinder block, thereby improving cooling efficiency of the engine.

However, according to the above conventional art, sound insulation is not taken into consideration and the engine is provided with only a structure for guiding cooling air wherein the cylinder head and a cylinder are arranged to be surrounded by an air exhaust flange.

On the other hand, attaching of a cover on an engine is an ordinary technique for preventing emission or transmission of vibration, noise, etc. caused by driving an engine. In this case, the cover is arranged to cover an overall body of the engine so that the engine must have a large housing. Furthermore, attachment of the cover must be a time and labor consuming task, thereby making maintenance work harder. Furthermore, for attaching a cover onto a general purpose engine, a different cover is required corresponding to a type of working vehicle to which the engine is mounted.

SUMMARY OF THE INVENTION

According to the present invention, an engine whose cylinder head is covered at three of front, rear, right and left sides thereof by a fuel tank, an air cleaner and a muffler, respectively, comprises a cover which covers the remaining one side and/or a top side of the cylinder head. Due to this structure, the cylinder head can be protected by the cover, and noise caused by the cylinder head can be reduced. Furthermore, the cover can send cooling air from a fan provided on one side of a cylinder block via the cylinder head to an exhaust pipe disposed on the opposite side of the cylinder block, which is an exposed side of the cylinder head where no device such as a muffler is disposed. Therefore, the cylinder head and the exhaust pipe can be cooled.

According to the invention, the cover is formed to have an approximate inverse L shape in a section view so as to cover an exposed side of the cylinder head and the top of the cylinder head. Due to this structure, sound insulation is improved to reduce noise caused by the cylinder head. Furthermore, cooling air from a fan provided on one side of the cylinder block can be guided to cool the cylinder head as well as a bonnet cover, etc. disposed over the cylinder head, thereby improving cooling efficiency. Still further, the cover covers the exhaust pipe disposed on the exposed side of the cylinder head, thereby preventing users from accidentally touching the exhaust pipe. In addition, the cover can be used as a means for covering a base portion of a muffler (a joint between the muffler and the exhaust pipe).

According to the invention, the cover comprises a side cover to cover the exposed side of the cylinder head and a top cover to cover the top side of the cylinder head. Due to this structure, the cover can be separated into the top cover and the side cover, thereby facilitating attachment of the cover onto the engine. Furthermore, the top cover or the side cover can be removed individually so that parts desired to be detached from the engine can be easily detached, thereby enhancing ease of maintenance.

According to the invention, the side cover and the top cover are integrally formed. Due to this structure, attachment work of the cover onto the engine is made easier.

According to the invention, the side cover is bent corresponding to a shape of an exhaust pipe disposed on a side surface of the cylinder head. Due to this structure, the side cover covers the exhaust pipe, thereby preventing users from accidentally touching the exhaust pipe.

According to the invention, the side cover is disposed on a side of the cylinder head opposite to the air cleaner. Due to this structure, the cylinder head is covered at the front, rear, left and right sides thereof by the muffler, the fuel tank, the air cleaner and the side cover, and also covered by the top cover disposed thereabove, thereby improving sound insulation to reduce noise caused by the cylinder head. Furthermore, the side cover covers an exposed portion of the cylinder, thereby preventing users from accidentally touching the cylinder head, and also improving appearance of the engine.

According to the invention, a fan is disposed on one side of a cylinder block beneath the cylinder head, and the side cover is extended to cover another side of the cylinder block opposite to the fan. Due to this structure, the side cover functions as a guiding plate to guide cooling air from the fan to an outer surface of the cylinder block opposite to the fan. Therefore, the whole body of the cylinder head is cooled down, and further the surface of the cylinder block opposite to the fan is also cooled down.

According to the invention, the side cover has a notched upper edge portion fixed on a side surface of the top cover. Due to this structure, an operating portion of a decompressor provided on the engine can be disposed at the notched portion without projecting to the outside of the side cover. Therefore, the operating portion of the decompressor can be operated without having to detach the cover from the engine, thereby keeping good appearance of the engine. Furthermore, the top cover and the side cover can be joined to form an approximate inverse L shape, thereby improving appearance of the engine.

According to the invention, the side cover is formed on a side surface thereof with an opening. Due to this structure, cooling air can be sufficiently drawn out from the opening, thereby improving cooling efficiency. In addition, weight of the side cover can be reduced by the area of the opening.

According to the invention, the side cover has a lower edge portion whose at least one side is perpendicularly bent to form a projection inserted into a slit formed in a main body of the engine so as to attach the side cover to the main body. Due to this structure, the side cover can easily be fixedly positioned with respect to the main body of the engine. Furthermore, a fixed portion can be easily formed in the side cover.

According to the invention, the top cover is formed on a top surface thereof with an attachment hole for attachment of the top cover onto the engine, periphery of the attachment hole being funnel-formed and the attachment hole being formed with a slit on an inner side surface thereof. Due to this structure, water is drained through the slit, thereby preventing water from ponding on the top surface of the top cover when, for example, rainwater falls on the top surface of the top cover. Furthermore, water draining structure can be easily formed on the top cover.

According to the invention, the top cover is formed on a top surface thereof with a hole for inserting a lifting member and a hole for feeding startup assisting material. Due to this structure, a lifting member for lifting up the engine can be easily attached to the cylinder head without having to detach the top cover from the engine. Therefore, the engine can be easily lifted up only by the lifting member without any additional member such as a guide member attached on the main body of the engine. And, also due to this structure, startup assisting material can be fed from the latter hole without having to detach the top cover from the main body of the engine.

According to the invention, an operating portion of a decompressor is disposed below a top surface of the top cover. Due to this structure, the operating portion of the decompressor does not jut out above the top surface of the top cover, thereby keeping good appearance of the engine.

According to the invention, the operating portion of the decompressor is provided as a decompressor lever, and the side cover is formed thereon with a hole for inserting a control shaft of the decompressor lever, the decompressor lever being projected to the outside of the side cover. Due to this structure, the decompressor can be controlled with the decompressor lever in a state where the cover is attached on the engine.

According to the invention, a cooling air guide for guiding cooling air to a space between a bonnet cover and the top cover disposed over the cylinder head is formed in a cylinder head side of a body of the air cleaner. Due to this structure, cooling air from a fan can be guided and divided by the cooling air guide to cool the bonnet cover and a fuel injection nozzle as well as the cylinder head. Furthermore, the cooling air guide can be easily formed by casting, etc.

According to the invention, the cooling air guide is integrally formed on a partition wall formed in the cylinder head side of the body of the air cleaner. Due to this structure, the cooling air guide can be produced cost-effectively because it requires neither special additional part attached onto the body of the air cleaner nor processing of the body.

DETAILED DESCRIPTION OF THE INVENTION

Figure 1:
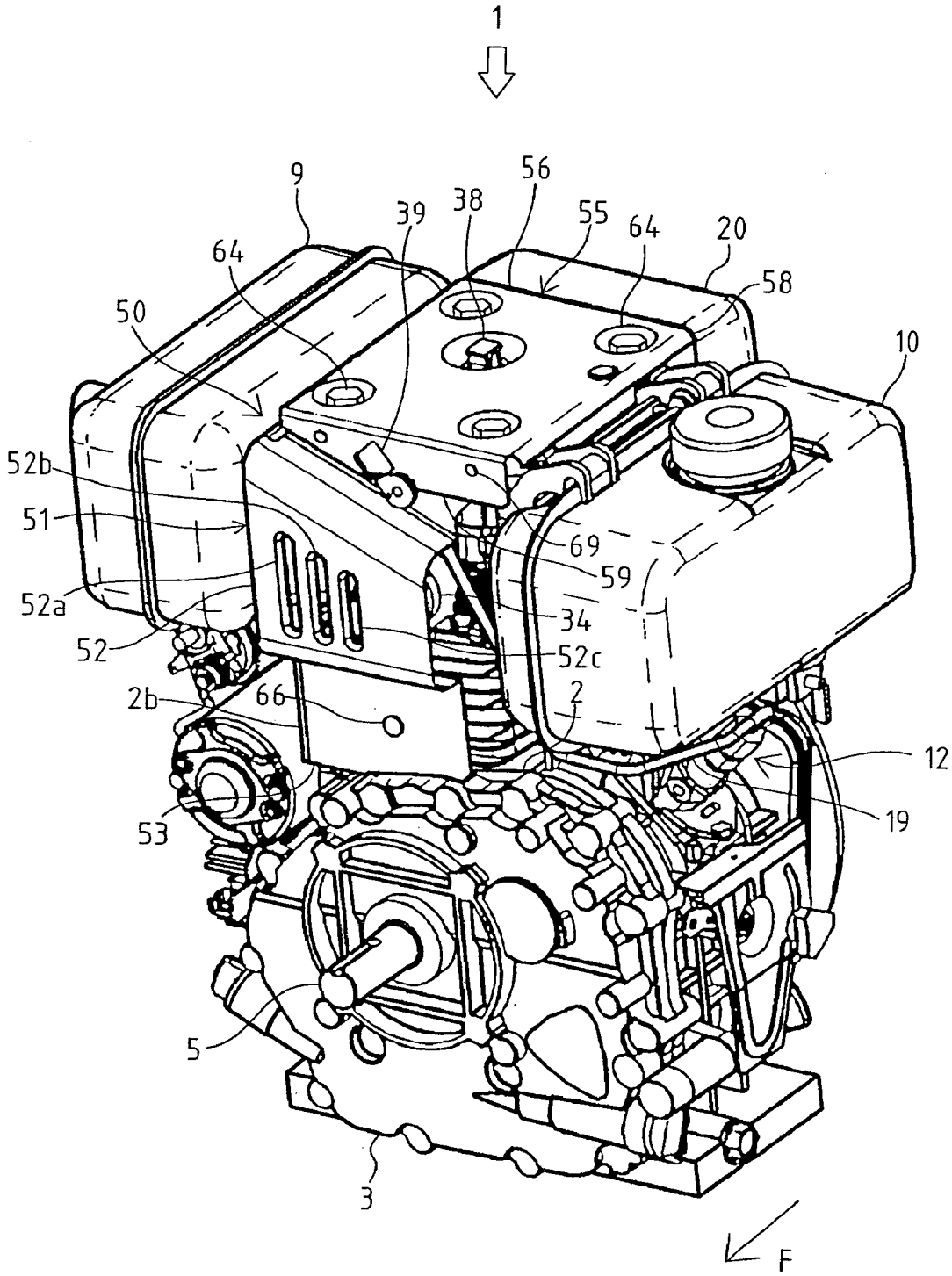
FIG. 1 is a perspective view of an engine attached thereon with a cover.
Figure 2:
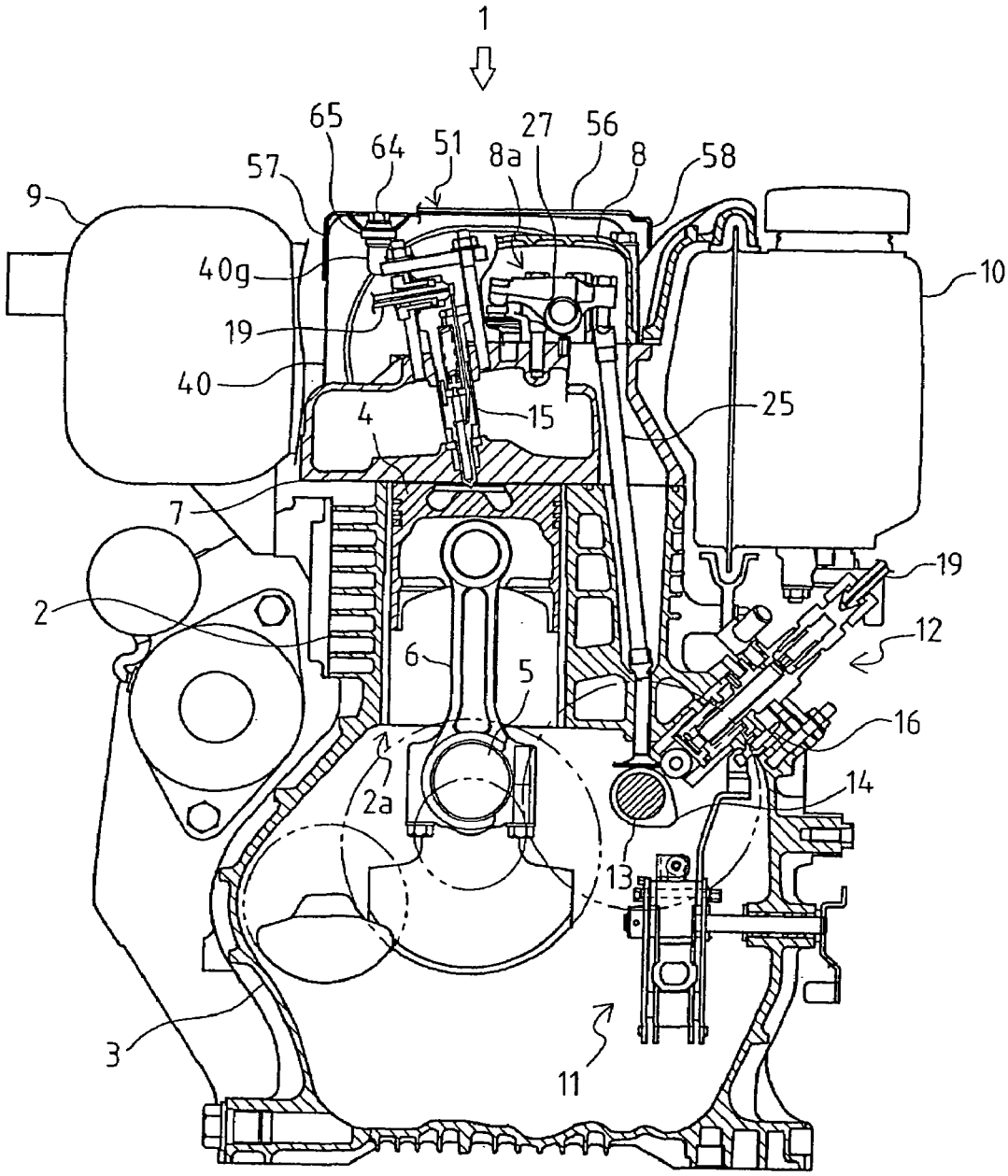
FIG. 2 is a sectional front view of the engine attached thereon with the cover.
Figure 3:
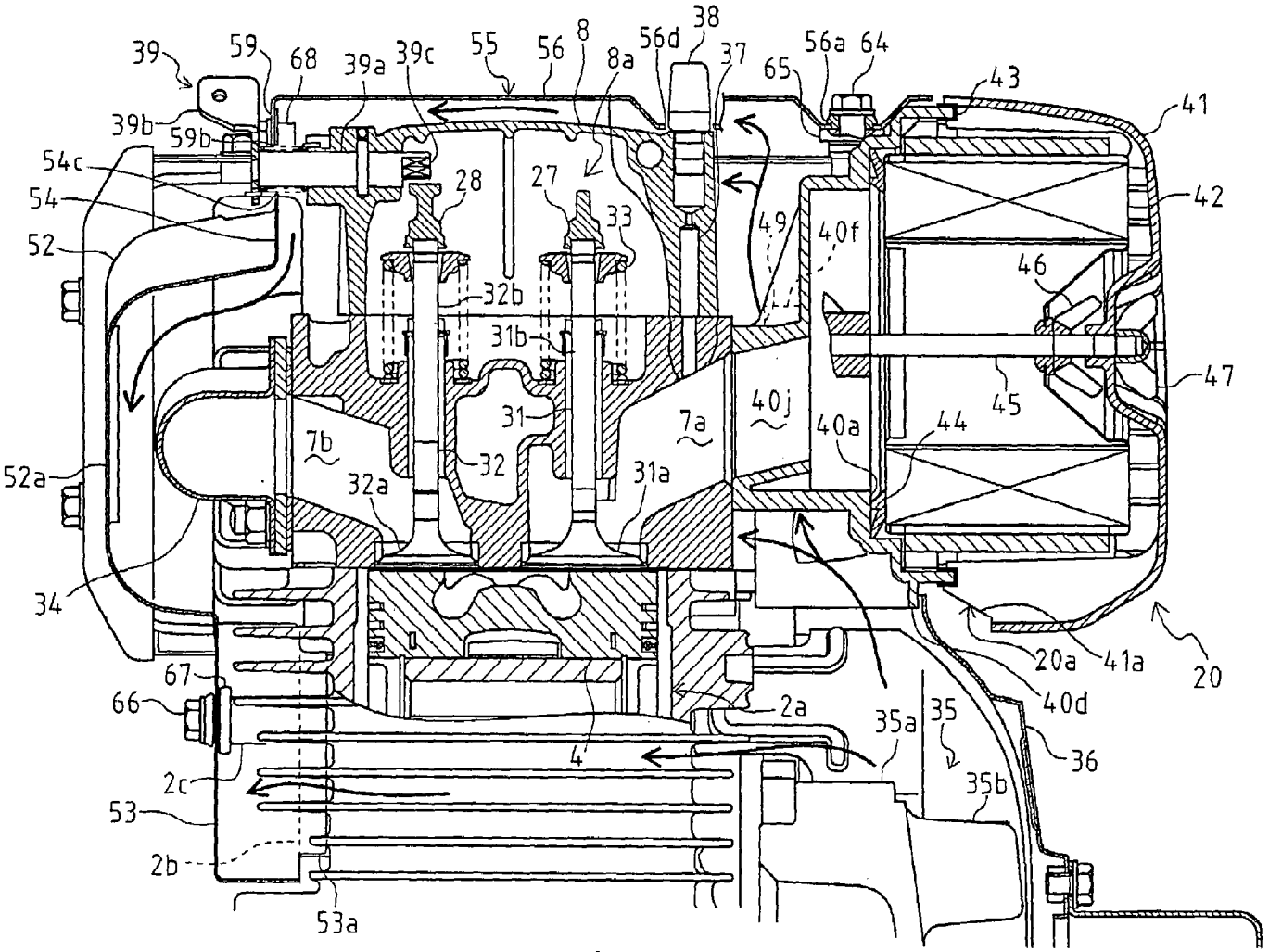
FIG. 3 is a sectional side view of an upper portion of the engine attached thereon with the cover.

Referring to FIG. 1 to FIG. 3, description will now be given of an overall structure of an air-cooled engine with a cover structure according to the present invention. Hereafter, the front side of the engine is assumed as indicated by an arrow F shown in FIG. 1.

An engine 1 comprises a cylinder block 2 in an upper part thereof and a crankcase 3 in a lower part thereof. In the middle of cylinder block 2 is formed a vertically-directed cylinder 2*a* with a piston 4. Piston 4 is connected via a connection rod 6 to a crankshaft 5 which is pivotally supported by crankcase 3.

A balance weight, a governor 11, etc. are disposed within crankcase 3 beneath cylinder block 2. A cam shaft 13, a fuel injection pump 12, etc. are disposed above governor 11. Fuel injection pump 12 draws fuel from a fuel tank 10 by pushing and pulling a plunger of fuel injection pump 12 with a pump-driving cam 14 provided on cam shaft 13 at the center thereof in the fore-and-aft direction, and supplies a certain amount of fuel to a fuel injection nozzle 15 via a high-pressure pipe 19 at a certain timing. The amount of fuel injection from nozzle 15 can be controlled by turning a control lever 16 of fuel injection pump 12 to change a stroke of the plunger.

On cylinder block 2 is disposed a cylinder head 7, inside of which a suction valve 31, an exhaust valve 32 and fuel injection nozzle 15 are disposed. A bonnet cover 8 is provided on cylinder head 7 forming a rock arm chamber 8*a*, within which upper end portions of respective suction valve 31 and exhaust valve 32, upper end portions of respective rock arms 27 and 28 and a pushrod 25, etc. are disposed. Three out of four sides (front, rear left and right sides) of cylinder head 7 and bonnet cover 8 are surrounded by a muffler 9, fuel tank 10 and an air cleaner 20. According to the present embodiment, muffler 9, fuel tank 10 and air cleaner 20 are respectively disposed in the right, left and rear sides of cylinder head 7. The remaining side (front side) and an upper side of cylinder head 7 are respectively covered with a side cover 51 and a top cover 55 of a cover 50.

A fan 35 is disposed on one side (rear side) of cylinder block 2 under air cleaner 20. Fan 35 consists of a flywheel 35*a* which is fixed on one end of crankshaft 5 and integrally formed with fins 35*b* on a peripheral portion of an outer side surface thereof. Fan 35 is covered by a fan case 36. By rotating fan 35, air is drawn into fan case 36 from outside and then sent toward cylinder block 2, cylinder head 7, etc. to cool them. The air is also supplied to air cleaner 20.

As shown in FIG. 3, suction valve 31 (exhaust valve 32) comprises a valve head 31*a* (32*a*) as a bottom part thereof and a valve rod 31*b* (32*b*) as a body part thereof and is disposed over piston 4. Valve head 31*a* (32*a*) is arranged so that it can be fitted or separated on and from a valve seat formed on a bottom surface of cylinder head 7, thereby connecting or disconnecting a suction port 7*a* (a exhaust port 7*b*) formed in cylinder head 7 to and from an inside space of cylinder 2*a* formed in cylinder block 2. Suction port 7*a* is connected to air cleaner 20 provided behind cylinder head 7. Exhaust port 7*b* is connected to muffler 9 via an exhaust pipe 34 provided before cylinder head 7.

Valve rod 31*b* (32*b*) is slidably inserted into cylinder head 7 and projecting upward to the bonnet cover 8 side. A top end of valve rod 31*b* (32*b*) is contacted with a rock arm 27

(28). Inside rock arm chamber 8*a*, a spring 33 (33) is put on valve rod 31*b* (32*b*) so that valve head 31*a* (31*b*) is biased to slide upward and shut suction valve 31 (exhaust valve 32).

Fuel injection nozzle 15 is disposed between suction valve 31 and exhaust valve 32. Fuel injection nozzle 15 is inserted into cylinder head 7 and projects downward with a tip thereof (an injecting portion) positioned above a center of cylinder 2*a*. Fuel injection nozzle 15 is connected at the other end thereof to high pressure pipe 19 extending from fuel injection pump 12 so as to inject fuel supplied from fuel injection pump 12 into cylinder 2*a*.

Cylinder head 7 and bonnet cover 8 are pierced at one ends thereof by a vertical connecting hole 37. Connecting hole 37 is connected to suction port 7*a*. Startup-assisting material is injected into cylinder 2*a* from connecting hole 37 through suction port 7*a* for assisting smooth startup of an engine under the condition of low temperature. When injecting operation is not performed, connecting hole 37 is normally plugged with a cap 38 to prevent an extraneous substance from entering into cylinder 2*a* and mixing with internal air.

A decompressor 39 is provided on bonnet cover 8. Decompressor 39 forcedly opens exhaust valve 32 or suction valve 31 at engine startup in order to decrease a compressive force inside cylinder 2*a* and reduce a cranking force, thereby enhancing starting performance of the engine. (In this embodiment, decompressor 39 is typically provided on exhaust valve 32.) Decompressor 39 comprises a control shaft 39*a* pivotally supported by bonnet cover 8 and a decompressor lever 39*b* attached to control shaft 39*a* as an operating portion.

Control shaft 39*a* of decompressor 39 is disposed horizontally in the fore-and-aft direction, and turnably supported by bonnet cover 8. Decompressor lever 39*b* is integrally fixed on one end of control shaft 39*a* projecting forward to the outside. The other end of control shaft 39*a* projecting into the inside of rock arm chamber 8*a* is formed with a notched semicylindrical contacting portion 39*c*. Contacting portion 39*c* is arranged so that it can contact with rock arm 28. Therefore, as control shaft 39*a* is turned by decompressor lever 39*b*, contacting portion 39*c* comes to contact with rock arm 28 and push it. Then, rock arm 28 pushes exhaust valve 32 and slides it downward against the biased force of the spring, thereby opening exhaust valve 32. Therefore, when piston 4 moves upward, air inside cylinder 2*a* is not compressed as it is exhausted from exhaust valve 32. As a result, crankshaft 5 can be rotated with a little driving force.

As shown in FIG. 3, air cleaner 20 comprises a body 40, a cover 41 and an element 42. Cover 41 is fixed on body 40 via a seal member 43. Element 42 is contained between cover 41 and body 40. More concretely, air cleaner 20 is constructed in the following way: Body 40 is formed with a step-like shaped inward recess portion 40*a* so as to fit to periphery of element 42, element 42 is fitted via seal member 44 into recess portion 40*a* and fastened to body 40 by a bolt 45 with a nut 46, and finally, cover 71 is fixed to element 42 with a nut 47.

A suction opening 20*a* is formed at a bottom part of air cleaner 20 for sucking air directly from outside or from fan case 36. Suction opening 20*a* is formed by a cutaway part in a bottom periphery of cover 41 when cover 41 is fixed on body 40. Suction opening 20*a* opens downward so as to suck air into air cleaner 20 from outside. Further, a suction hole 40*j*, which serves as a flow path for air, is formed at a central part of body 40. Suction hole 40*j* and suction port 7*a* of cylinder head 7 are connected with each other.

Figure 5:
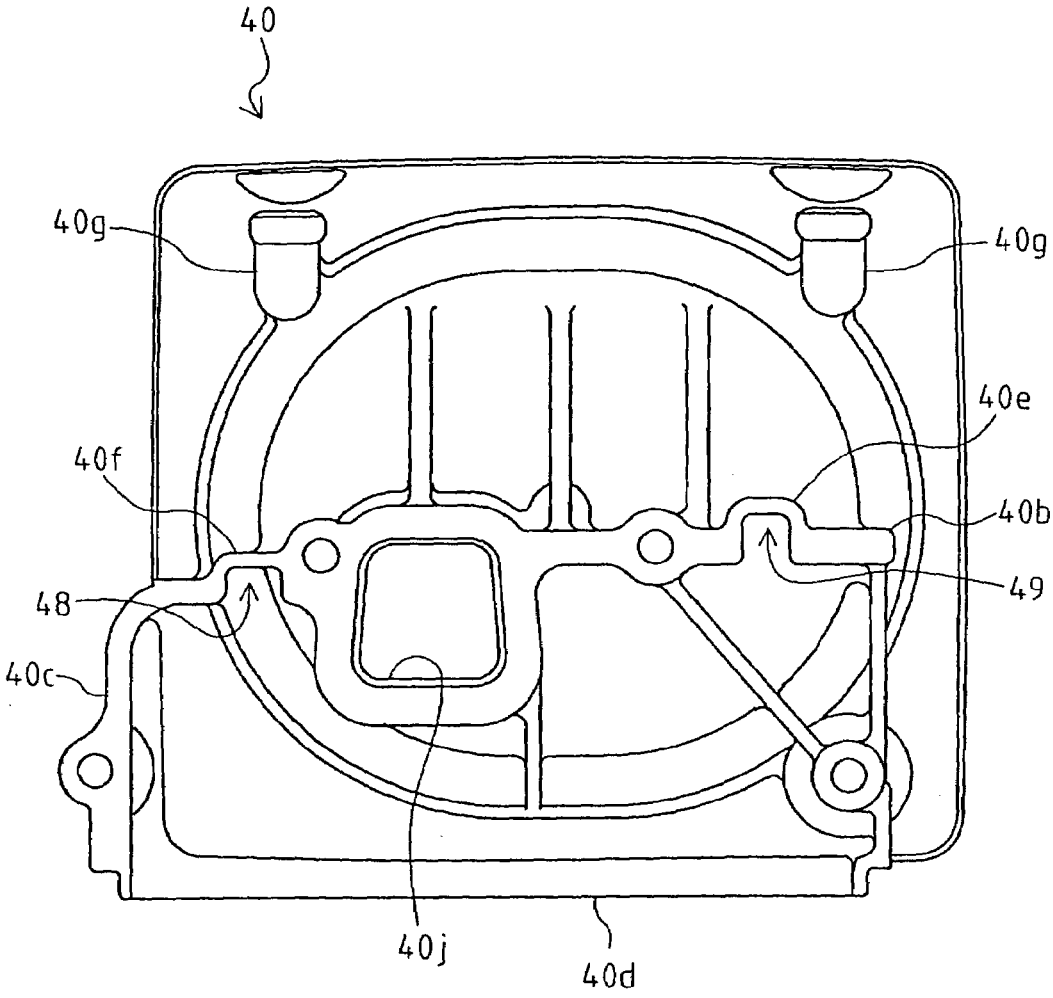
FIG. 5 is a front view of a body of an air cleaner.
Figure 6:
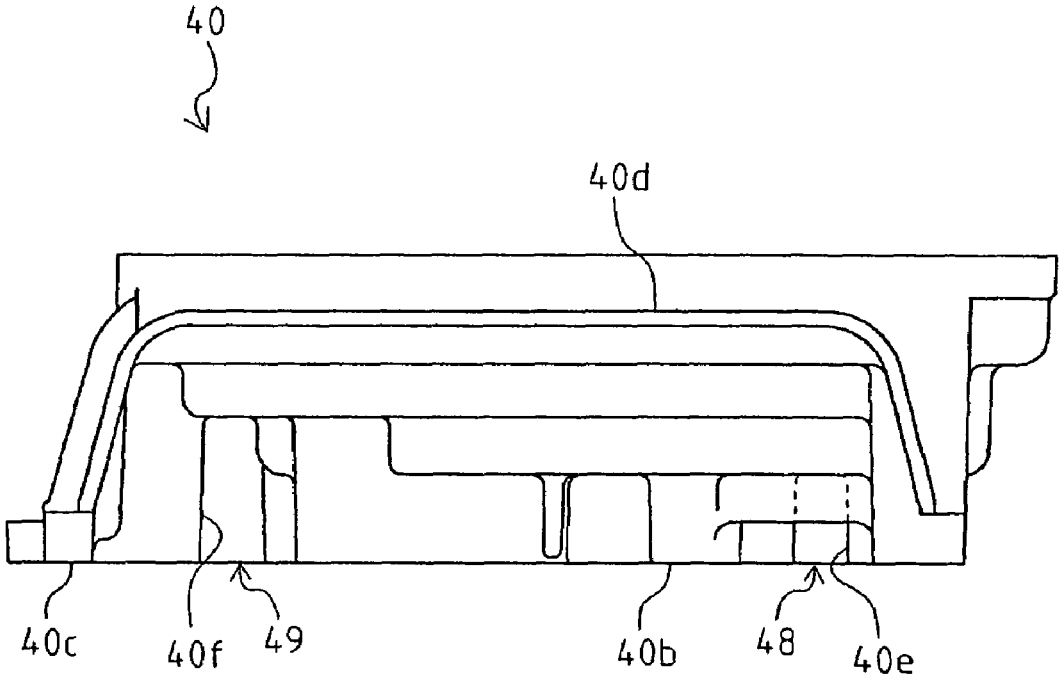
FIG. 6 is a bottom view of the body of the air cleaner.
Figure 7:
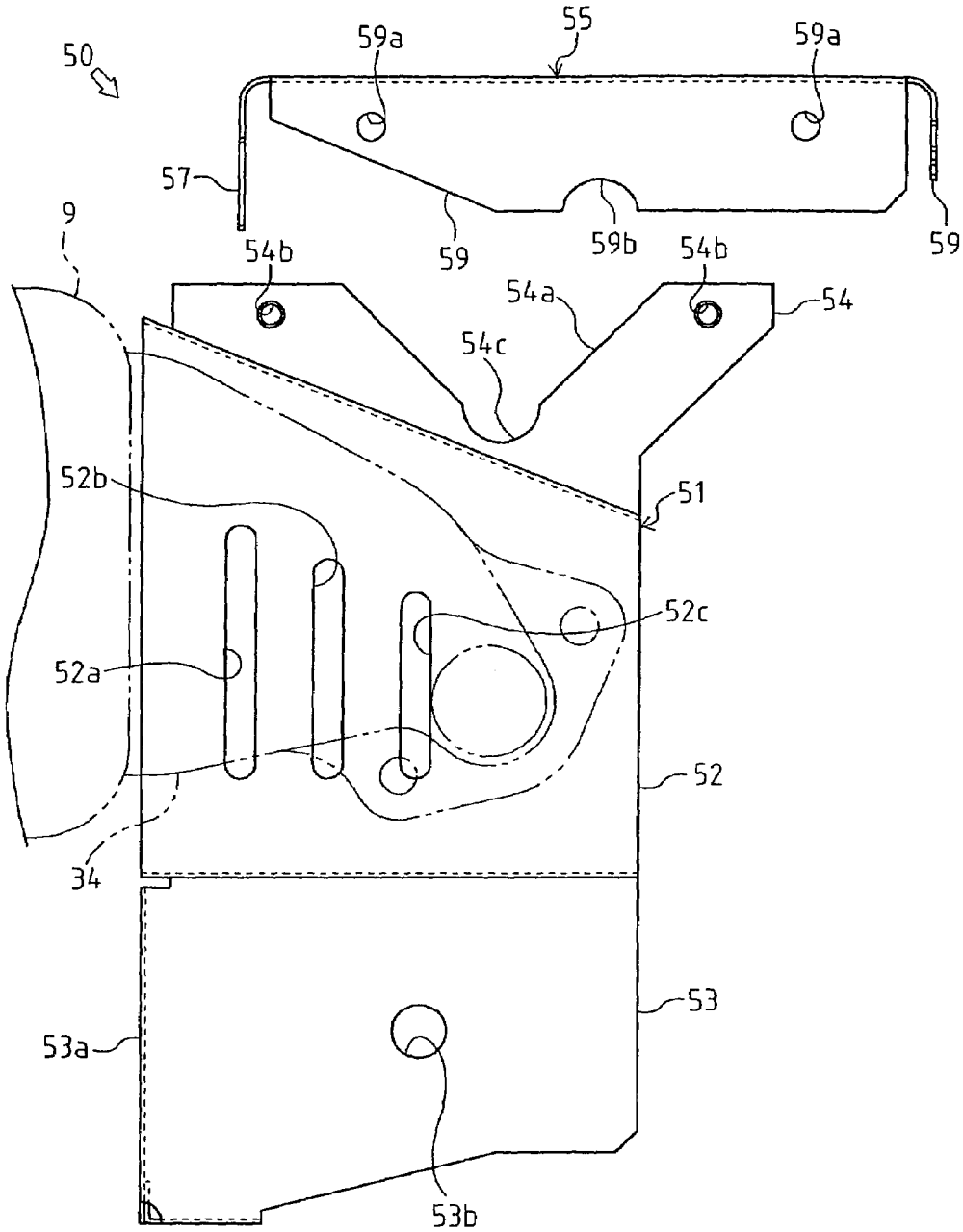
FIG. 7 is a front view of a side cover and a top cover.

As shown in FIG. 5 and FIG. 6, in a cylinder head 7 side of body 40 are integrally formed partition walls 40*b*, 40*c* and 40*d* for guiding cooling air sent by fan 35 from the fan case 36 side to the cylinder head 7 side. Partition wall 40*b* extends horizontally from a vertically middle part of body 40. Partition walls 40*c* are extended continuously from partition wall 40*b* and toward cylinder head 7 at both sides of a bottom part of body 40. Partition wall 40*d* is approximately U-shaped in a bottom view and extended downward from a bottom part of body 40 on the opposite side to the cylinder head 7. Partition walls 40*b* and 40*c* are formed therein with bolt holes for attachment of body 40 to cylinder head 7.

Furthermore, partition wall 40*b* and partition wall 40*c* are integrally formed at respective middle parts thereof with respective upwardly projecting cooling air guides 40*e* and 40*f* When body 40 is attached to cylinder head 7, cooling air guides 40*e* and 40*f* are positioned over a top surface of cylinder head 7 to respectively form openings 48 and 49 so that a space formed between partition walls 40*b*, 40*c* and 40*d* and cylinder head 7 is fluidly connected to a space formed between a later-discussed top cover 55 of cover 50 and cylinder head 7. Therefore, a part of cooling air flowing from fan 35 is guided by cooling air guides 40*e* and 40*f* of partition walls 40*b* and 40*c* so as not to be sent into cylinder head 7 but to be sent from openings 48 and 49 to a space between bonnet cover 8 and top cover 55 over cylinder head 7.

In this way, cooling air guides 40*e* and 40*f*, which serve as intakes of cooling air into the space between bonnet cover 9 and top cover 55 over cylinder head 7, are formed in the cylinder head 7 side of body 40 of air cleaner 20. Therefore, cooling air guides 40*e* and 40*f* can guide cooling air sent from fan 35 to bonnet cover 8 to cool it as well as cylinder head 7. Furthermore, cooling air guides 40*e* and 40*f* can be easily formed by casting, etc.

Furthermore, cooling air guides 40*e* and 40*f* are integrally formed on respective partition walls 40*b* and 40*c* which are formed in the cylinder head 7 side of body 40 of air cleaner 20 so that there is no need for any special additional part or for processing for body 40, thereby being produced cost-effectively.

Referring now to FIG. 1 and FIG. 7 through FIG. 9, description will be given of the cover structure of engine 1.

Cover 50 comprises side cover 51 and top cover 55. While the upper part of the engine includes cylinder head 7 covered at three of front, rear, left and right sides thereof with muffler 9, fuel tank 10 and air cleaner 20, side cover 51 is arranged at the upper part of the engine so as to cover the remaining one side of cylinder head 7. Top cover 55 is arranged to cover the top of cylinder head 7 and bonnet cover 8. Cover 50, which covers both the remaining side and the top of cylinder head 7 in the present embodiment, may be arranged to cover at least one of the remaining side and the top of cylinder head 7. Cover 50 may be arranged to cover a wider area in addition to the exposed part of cylinder head 7.

In the present embodiment, side cover 51 is placed on the front side of cylinder head 7 which is not covered by any of muffler 9, fuel tank 10 and air cleaner 20. Side cover 51 is arranged to also cover exhaust pipe 34 disposed in front of cylinder head 7 and to cover the corresponding side of an upper part of cylinder block 2.

Side cover 51 is formed to have a hat-like shape and, in a rear view, to have an approximately trapezoidal shape. In other words, a vertically middle part of side cover 51, which serves as a part to cover exhaust pipe 34, projects forward to form a projecting portion 52 whose right and left sides are opened. Projecting portion 52 is formed in such a way that a vertical width thereof is increased in the direction from cylinder head 7 to muffler 9 so as to fit the shape of exhaust pipe 34.

Furthermore, side cover 51 is formed on a front surface thereof with plural openings 52*a*, 52*b* and 52*c*. In this embodiment, openings 52*a*, 52*b* and 52*c* are three vertically long openings formed on projecting portion 52 of side cover 51 at regular intervals. However, the number and the shape of openings are not to be specified. For example, more than three openings may be provided on projecting portion 52. Alternatively, instead of these openings, heat may be exhausted through right and left sides or top and bottom sides of side cover 51 without any openings provided. Any arrangement is possible of side cover 51 for exhausting heat only if exhaust pipe 34 is prevented from being directly contacted by side cover 51.

Figure 8:
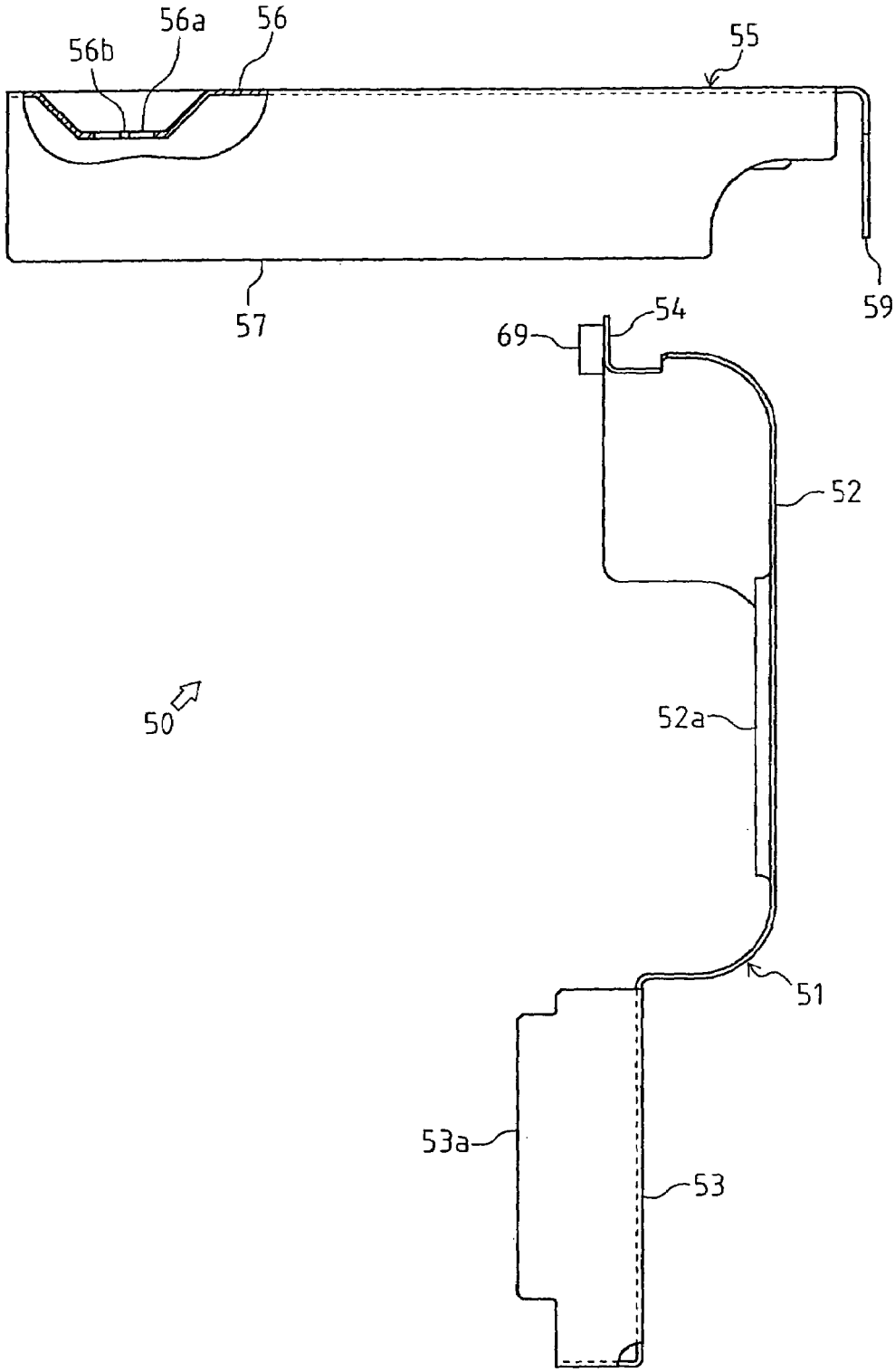
FIG. 8 is a right side view of the side cover and the top cover.
Figure 9:
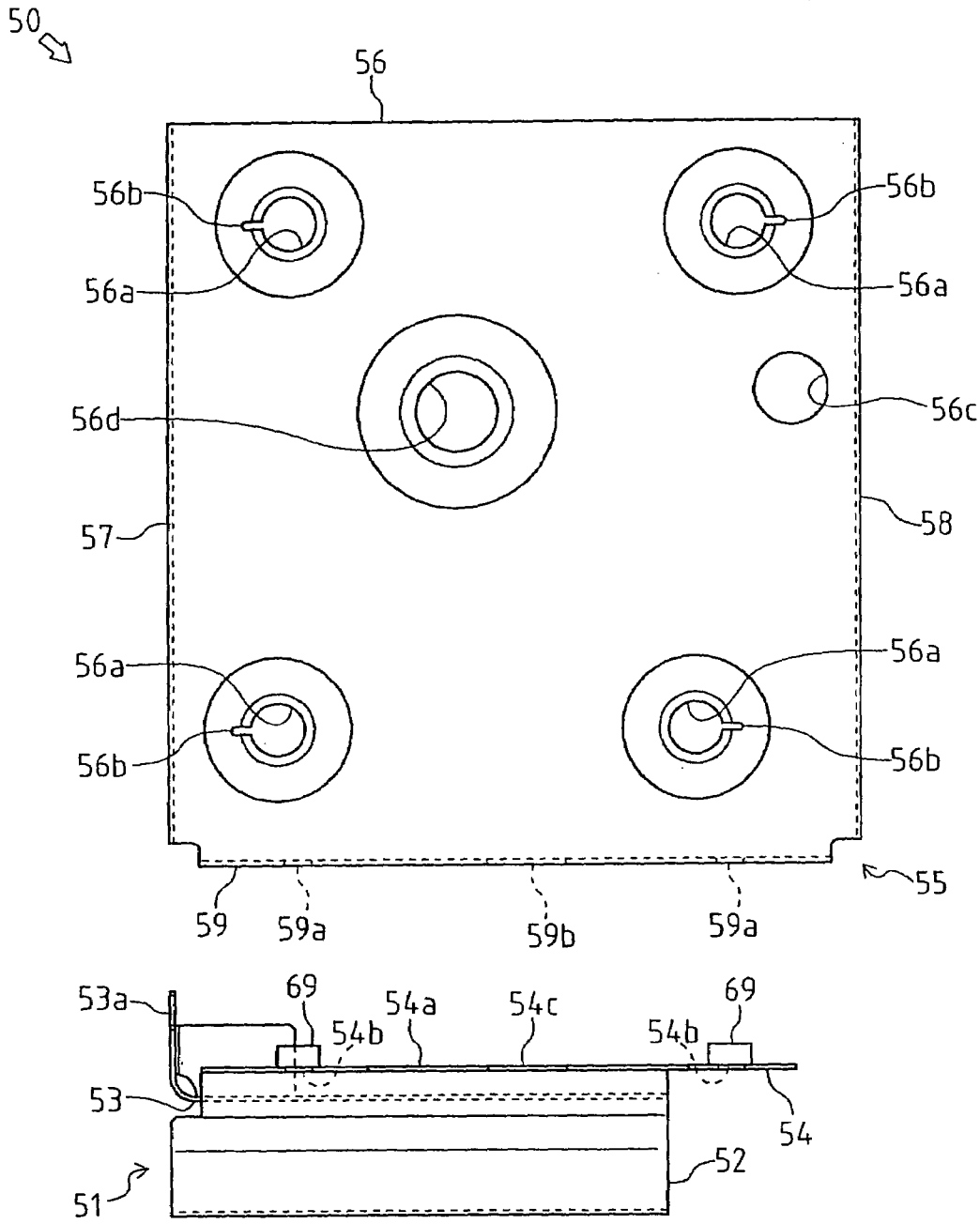
FIG. 9 is a plan view of the side cover and the top cover.

As shown in FIG. 8 and FIG. 9, side cover 51 has a lower edge portion 53 whose at least one side is squarely bent so as to form a projection 53*a*. As shown in FIG. 3, a vertical slit 2*b* is formed through plural laterally horizontal fins for radiating heat projecting from a front side of a main body of engine 1 (cylinder block 2). By inserting projection 53*a* into slit 2*b*, side cover 41 can be easily positioned with respect to the main body of engine 1 and fixed on it.

On the other hand, a recess 54*a*, which is approximately V-shaped in a side view, is formed in an upper end portion 54 of side cover 51. Recess 54*a* has a closed arcuate end part 54*c* which is disposed on the axial line of control shaft 39*a* of decompressor 39 projecting forward from bonnet cover 8 when side cover 51 is attached on the main body of engine 1. Decompressor lever 39*b* on the outer end of control shaft 39*a* is positioned in recess 54*a* lower than the top of projecting part 52 of side cover 51, that is, in a receding part of side cover 51. Therefore, decompressor lever 39*b* does not protrude to the outside of side cover 51, thereby keeping good appearance of engine 1. Here, it should be noted that recess 54*a* may also be easily formed by punching, etc. The shape of recess 54*a* is not limited.

Furthermore, side cover 51 is provided at lower end portion 53 thereof with an attachment hole 53*b* for attachment of side cover 51 to the main body of the engine (cylinder block 2), and at upper end portion 54 thereof with plural attachment holes 54*b* and 54*b* for attachment of side cover 51 to top cover 55. A nut 68 is fixed on the inner side of upper end portion 54 of side cover 51 to correspond to attachment hole 54*b*.

Top cover 55 is disposed over cylinder head 7 to cover cylinder head 7, bonnet cover 8, etc. Top cover 55 is approximately rectangularly shaped, and a top surface 56 of top cover 55 is bent vertically downward at right, left and front sides thereof to form respective edge portions 57, 58 and 59.

Top cover 55 is provided on top surface 56 thereof with plural attachment holes 56*a* for attachment of top cover 55 to the main body of the engine. In this embodiment, four attachment holes 56*a* are provided, which are respectively arranged at four corners of top surface 56 of top cover 55.

As shown in FIG. 8 and FIG. 9, each attachment hole 56*a* is formed into a funnel shape having a peripherally lowered central part. A slit 56*b* is formed on the inner side surface of each attachment hole 56*a*. Therefore, top surface 56 of top cover 55 fixed with bolts or the like is prevented from ponding of rainwater dropping thereon since the rainwater is drained through slit 56*b*. In this way, water draining structure is easily formed by providing slit 56*b*.

Figure 4:
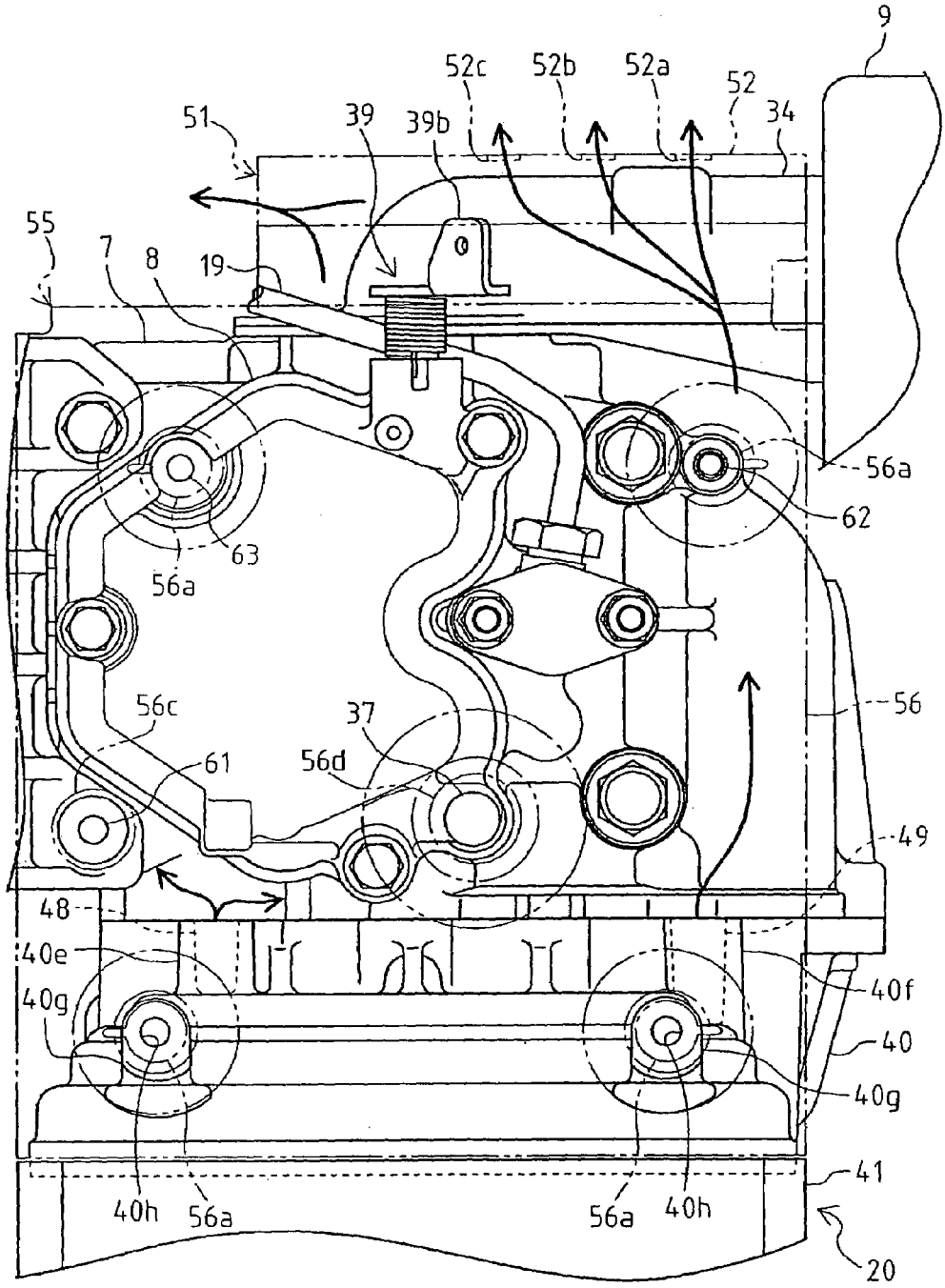
FIG. 4 is a plan view of the upper portion of the engine.

Furthermore, top cover 55 is formed on top surface 56 thereof with a lifting member insertion hole 56*c* and a startup assisting material injection hole 56*d*. As shown in FIG. 4, lifting member insertion hole 56*c* is positioned to correspond to a bolt hole 61 formed on the top surface of cylinder head 7. Lifting member insertion hole 56*c* is normally closed with a bolt. During lifting operation, the bolt is removed from lifting member insertion hole 56*c*, and an attachment member, such as an eyebolt, is screwed through lifting member insertion hole 56*c* into a boss or the like formed in cylinder head 7. Therefore, when engine 1 is transferred or engine 1 is installed on a working vehicle, engine 1 can be lifted by use of a lifting member easily attached on cylinder head 7 without removing top cover 55 from engine 1. Thus, engine 1 requires no additional member such as a guide member onto the main body thereof to be lifted since engine 1 can be easily lifted by only the lifting member.

Startup assisting material injection hole 56*d* is positioned so that an opening thereof corresponds to the connecting hole 37 formed on bonnet cover 8 and cylinder head 7. Startup assisting material injection hole 56*d* has a width enough to pass cap 38 fitted into connecting hole 37 therethrough, so that cap 38 can be removed from startup assisting material injection hole 56*d* while keeping top cover 55 attached on the main body of engine 1. Therefore, startup assisting material can be injected into cylinder 2*a* from startup assisting material injection hole 56*d* via connecting hole 37 by opening connecting hole 37 without removing top cover 55 from the main body of engine 1.

Furthermore, of edge portions 57, 58 and 59 of top cover 55, front edge portion 59, which doesn't contact with any of muffler 9, fuel tank 10 and air cleaner 20, is formed thereon with plural attachment holes 59*a* and 59*a* for attachment of side cover 51 onto top cover 55. Further, edge portion 59 is formed in a lower end part thereof with a notched arcuate portion 59*b* that faces arcuate portion 54*c* of recess 54*a* formed on upper end portion 54 of side cover 51.

Referring to FIG. 3 and FIG. 4, description will now be given of attachment structure of cover 50.

Top cover 55 of cover 50 is attached on body 40 of air cleaner 20, cylinder head 7 and bonnet cover 8. Side cover 51 of cover 50 is attached on cylinder block 2 and top cover 55.

Body 40 of air cleaner 20 is formed in a cylinder head side thereof with projecting boss portions 40*g* and 40*g* for attachment of top cover 55. Each boss portion 40*g* is formed with a vertical bolt hole 40*h*. Of attachment holes 56*a* formed on top cover 55, attachment holes 56*a* and 56*a* disposed in the air cleaner 20 side of top cover 55 are arranged to correspond to bolt holes 40*h* of boss portions 40*g*. Then, a bolt 64 is screwed into bolt hole 40*h* of boss portion 40*g* through attachment hole 56*a* of top cover 55 and an interposal member 65, such as a rubber cushion, thereby fastening top cover 55 onto body 40 of air cleaner 20.

Also, on the top surfaces of cylinder head 7 and bonnet cover 8 are formed respective vertical bolt holes 62 and 63 for attachment of top cover 55. The remaining attachment holes 56*a* and 56*a* of top cover 55 are arranged to correspond to respective bolt holes 62 and 63. Then, bolts 64 and 64 are screwed into bolt holes 62 and 63 through attachment holes 56*a* of top cover 55, interposal members and bosses, respectively, thereby fastening top cover 55 onto cylinder head 7 and bonnet cover 8.

Furthermore, as shown in FIG. 3, side cover 51 is arranged to cover exhaust pipe 34 with projecting portion 52, and projection 53*a* on lower end portion 53 of side cover 51 is inserted into slit 2*b* formed on the side surface of cylinder block 2, thereby positioning and fixing side cover 51.

Furthermore, attachment hole 53*b* formed on lower end portion 53 of side cover 51 is arranged to correspond to the bolt hole in boss portion 2*c* projecting from the front surface of cylinder block 2. Then, a bolt 66 is screwed into the bolt hole of boss portion 2*c* through attachment hole 53*b* of side cover 51 and an interposal member 67, thereby fastening side cover 51 onto cylinder block 2.

Furthermore, upper end portion 54 of side cover 51 is fitted onto front edge portion 58 of top cover 55 so that attachment holes 59*a* and 59*a* on front edge portion 58 correspond to respective attachment holes 54*b* and 54*b* on upper end portion 54 of side cover 51. Then, a bolt 69 is screwed into nut 68 on upper end portion 54 interposing through attachment holes 54*b* and 59*a*, thereby fastening side cover 51 onto top cover 55. In this way, top cover 55 and side cover 51 are joined so as to form approximately inverse L-like shaped cover 50, thereby achieving better appearance of engine 1. Alternatively, top cover 55 and side cover 51 may be integrally formed. In this case, attachment of cover 50 onto engine 1 is made easier.

At a joint between side cover 51 and top cover 55, a circular opening is formed by fitting arcuate portion 54*c* of recess 54*a* formed in upper end portion 54 of side cover 51 and arcuate portion 59*b* formed in front edge portion 59 of top cover 55. Control shaft 39*a* of decompressor 39 is protruded from the opening. Decompressor lever 39*b* fixed on the outside end of control shaft 39*a* is positioned below top surface 56 of top cover 55 and above projecting portion 52 of side cover 51 so as not to protrude to the outside of top cover 55 and side cover 51. Therefore, decompressor 39 is operable by decompressor lever 39*b* in the state that cover 50 is attached on engine 1, thereby keeping good appearance of engine 1.

In this way, top cover 50 is made up of separable top cover 55 and side cover 51, thereby facilitating attachment of cover 50 onto engine 1. Furthermore, maintenance of engine 1 is also facilitated because top cover 55 or side cover 51 can be removed separately from engine 1 so that parts desired to be detached from engine 1 can be easily detached.

Furthermore, sound insulation is improved because cylinder head 7 is covered by cover 50 which blocks out noise caused by cylinder head 7. More in detail, the noise caused by cylinder head 7 is reduced because three sides (out of front, rear, left and right sides) of cylinder head 7 are covered by fuel tank 10, air cleaner 20 and muffler 9, the remaining one side of cylinder head 7 is covered by side cover 51, and the upper side of cylinder head 7 is covered by top cover 55.

In addition, users are prevented from accidentally touching exhaust pipe 34 because side cover 51 covers exhaust pipe 34 which is disposed in the exposed side of cylinder head 7, that is, in the side where devices such as muffler 9 are not disposed.

Furthermore, cover 50 attached on the main body of engine 1 as described above functions as a guiding plate to guide the cooling air from fan 35 to exhaust pipe 34 disposed on the opposite side to fan 35.

More specifically, as shown in FIG. 3 and FIG. 4, cooling air from fan 35 is guided by fan case 36 and sent out upward from an upper end portion of fan case 36 to a space between cylinder head 7 and air cleaner 20. In the space, the cooling air is guided and divided by partition walls 40*b*, 40*c* and 40*d* and cooling air guides 40*e* and 40*g* formed on body 40 of air cleaner 20. A part of the cooling air is led into a space between top cover 55 and bonnet cover 8 from openings 48 and 49 formed by cooling air guides 40*e* and 40*g*. Then, the cooling air flows forward to exhaust pipe 34 along top cover 55, bonnet cover 8 and cylinder head 7, and, finally, is let out from the right and left sides and openings 52*a*, 52*b* and 52*c* of projecting portion 52 of side cover 51.

In this way, cover 50 serves as a guide plate for guiding cooling air from fan 35 to exhaust pipe 34 via cylinder head 7. Therefore, cylinder head 7, bonnet cover 8, and exhaust pipe 34 disposed on the opposite side to cylinder head 7 can be cooled by the cooling air.

On the other hand, the rest of the divided cooling air is led into cylinder head 7 by partition walls 40*b*, 40*c* and 40*d*. The cooling air cools cylinder head 7 from the inside thereof. After getting out of cylinder head 7, the cooling air reunites with the other divided part of cooling air getting out of the space between top cover 55 and bonnet cover 8, and, finally, the reunited cooling air is let out from the right and left sides and openings 52*a*, 52*b* and 52*c* of projecting portion 52 of side cover 51.

Thus, due to openings 52*a*, 52*b* and 52*c* formed on the side surface of side cover 51, the cooling air flowing out from the cylinder head 7 side can be sufficiently drawn out from side cover 51 without staying inside, thereby improving cooling efficiency. In addition, the weight of side cover 51 is reduced by the total areas of openings 52*a*, 52*b* and 52*c*.

Here, cooling air from fan 35 also flows through a space between cylinder block 2 and muffler 9 and through a space between cylinder block 2 and fuel tank 10. The cooling air passes through the space between cylinder block 2 and muffler 9 and the space between cylinder block 2 and fuel tank 10 cooling these devices, and, finally, it is drawn out from the lateral sides of side cover 51.

Referring to FIG. 10 through FIG. 13, description will now be given of a second embodiment of the cover structure of engine 1.

Figure 10:
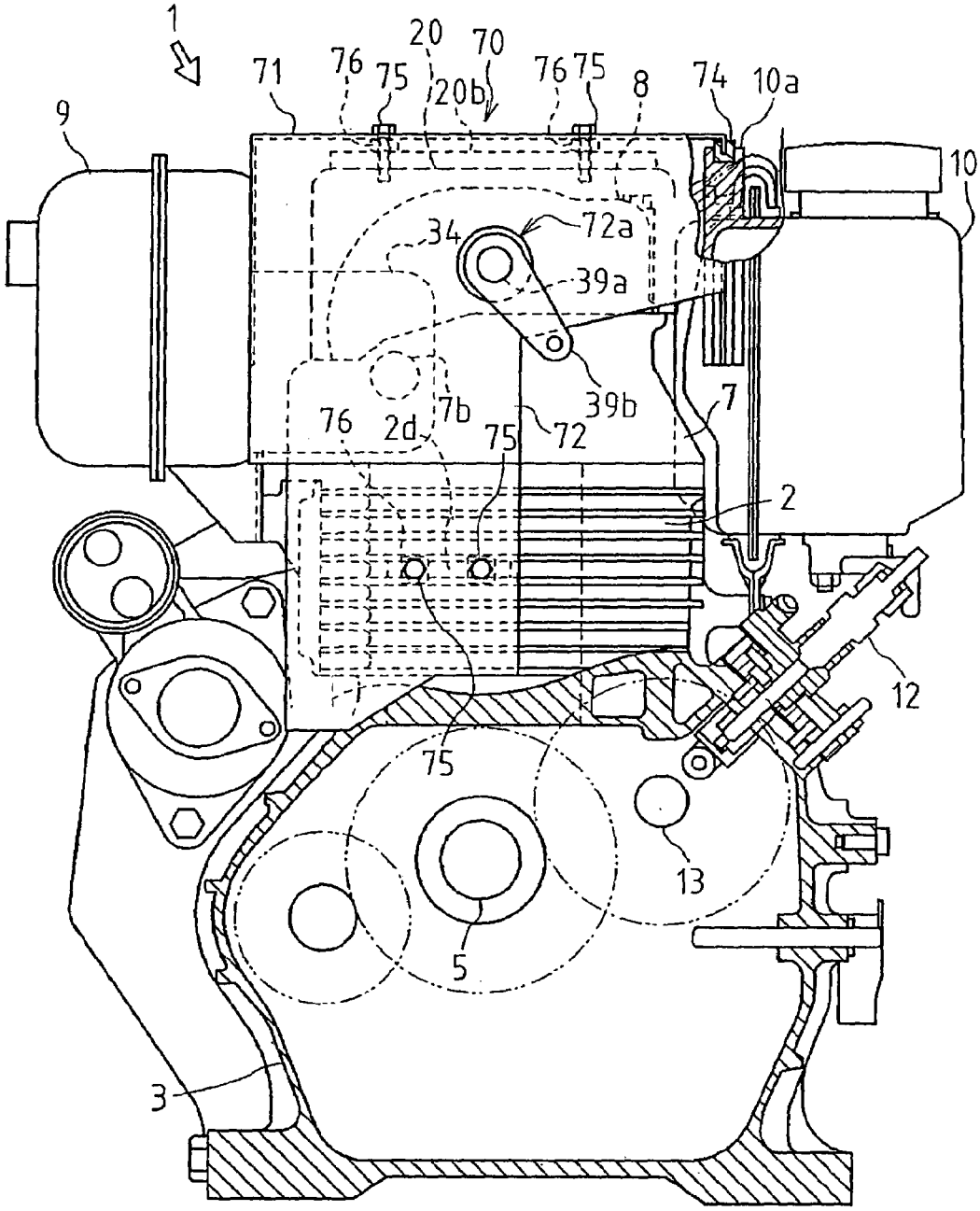
FIG. 10 is a front view of an engine attached thereon with a cover according to a second embodiment.
Figure 11:
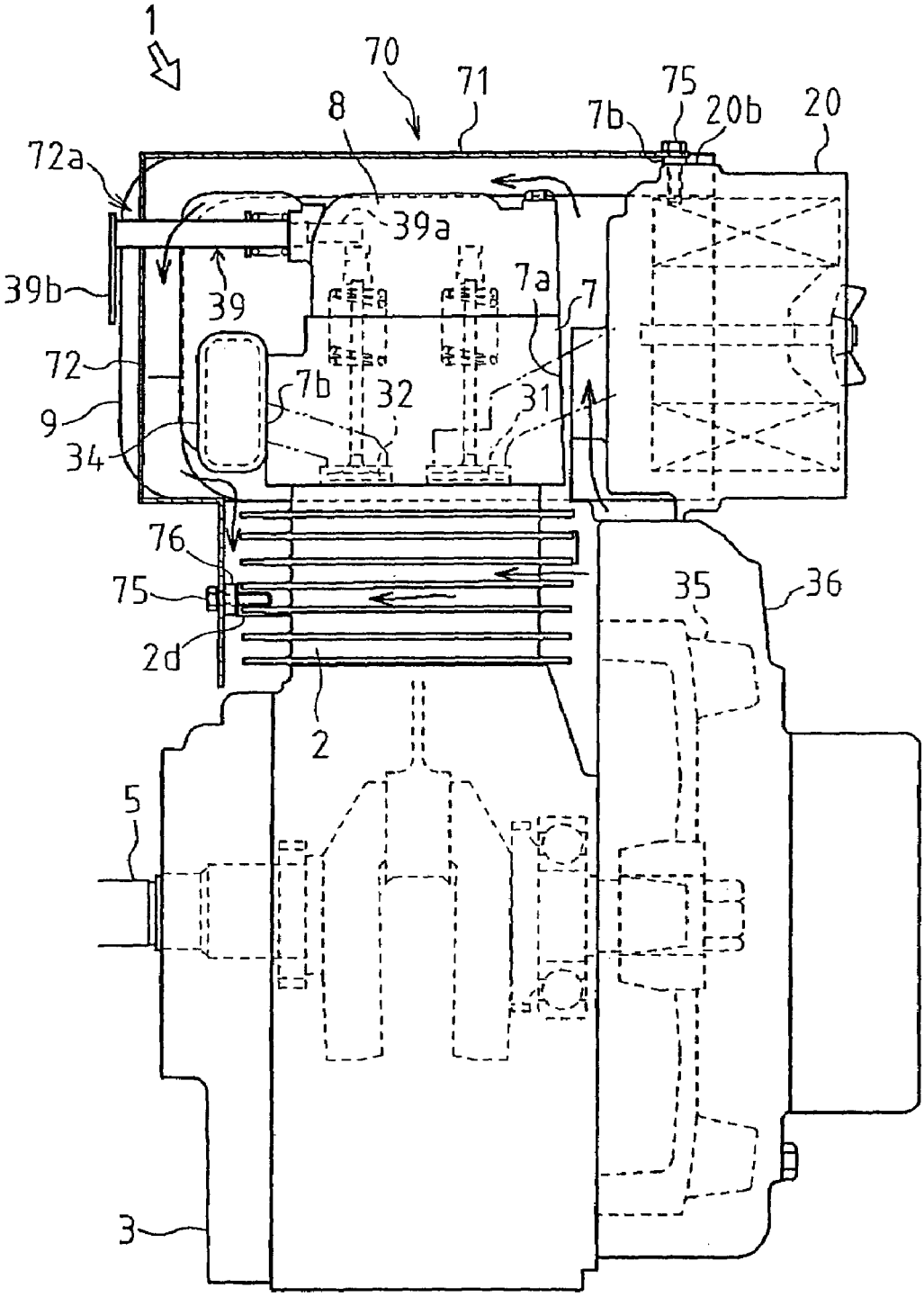
FIG. 11 is a side view of the engine attached thereon with the cover according to the second embodiment.

As shown in FIG. 10 and FIG. 11, in an upper part of engine 1, cylinder head 7 is covered at three sides (out of front, rear, left and right sides) thereof by muffler 9, fuel tank 10 and air cleaner 20. A cover 70 is provided to cover the remaining side and an upper side of cylinder head 7. Cover 70 is formed to have an approximate inverse L shape in a section view, and arranged to protect exposed portions of cylinder head 7, bonnet cover 8, etc. and to reduce noise caused by cylinder head 7, bonnet cover 8, etc.

While muffler 9 and fuel tank 10 are arranged to project over and forward of cylinder head 7, cover 70 is spaced from cylinder head 7 so that a top surface of cover 70 is substantially aligned with one, two or all of top surfaces of muffler 9, fuel tank 10 and air cleaner 20, and a side surface of cover 70 is substantially aligned with at least one of side surfaces (front surfaces) of muffler 9 and fuel tank 10. In this way, projections and depressions on the outer surface of engine 1 are reduced, thereby improving appearance of engine 1.

Figure 13:
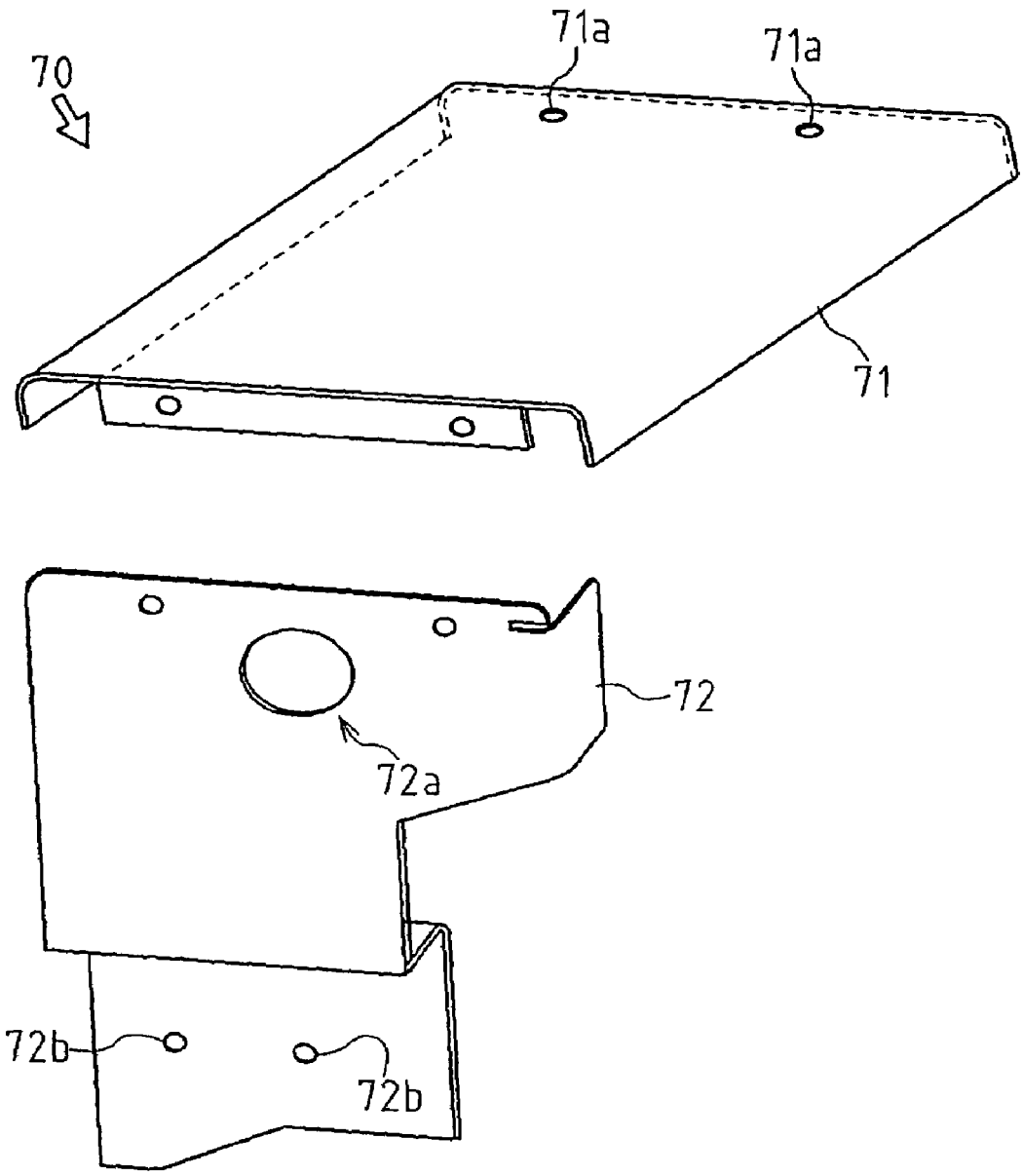
FIG. 13 is a perspective view of a side cover and a top cover of the cover according to the second embodiment.

As shown in FIG. 13, cover 70 comprises a horizontal top cover 71 as an upper part thereof and a vertical side cover 72 as a side part thereof. Top cover 71 is substantially rectangular in a plan view, and right and left sides thereof are bent vertically downward to form edge portions. Top cover 71 may be made of, for example, vibration absorbing steel plate in order to improve sound insulation. Side cover 72 is bent twice in a vertically middle part thereof toward the cylinder side so as to have steps fitting the shape of exhaust pipe 34 disposed on the front surface of cylinder head 7. Also, side cover 72 is formed on a top surface thereof with a later-discussed insertion hole 72*a*. Cover 70 may comprise separate top cover 71 and side cover 72 which are mutually joined with bolts or other means. Alternatively, cover 70 may be made of a single member.

Now, description will given of a supporting structure of cover 70.

Cover 70 is attached on engine 1, being supported by housing portions of respective fuel tank 10 and air cleaner 20 and by an outer surface of cylinder block 2. Alternatively, cover 70 may be supported by bonnet cover 8 or cylinder head 7.

Firstly, description will be given of a supporting structure for cover 70 by the housing portion of fuel tank 10.

As shown in FIG. 10, fuel tank 10 is formed with an indented support portion 10*a* projecting from the housing portion thereof. A rubber cushion 74 is pressed in an indent of indented support portion 10*a*. Rubber cushion 74 is formed at a top thereof with a slit into which an end of cover 70 is inserted. Alternatively, indented support portion 70*a* itself may be made up of vibration absorbing members. The above-described three edge portions of top cover 71 are bent squarely and extending vertically downward. One of these downward extending portions is disposed on a fuel tank 10 side to be fitted in upwardly opened indented support portion 10*a*.

Figure 12:
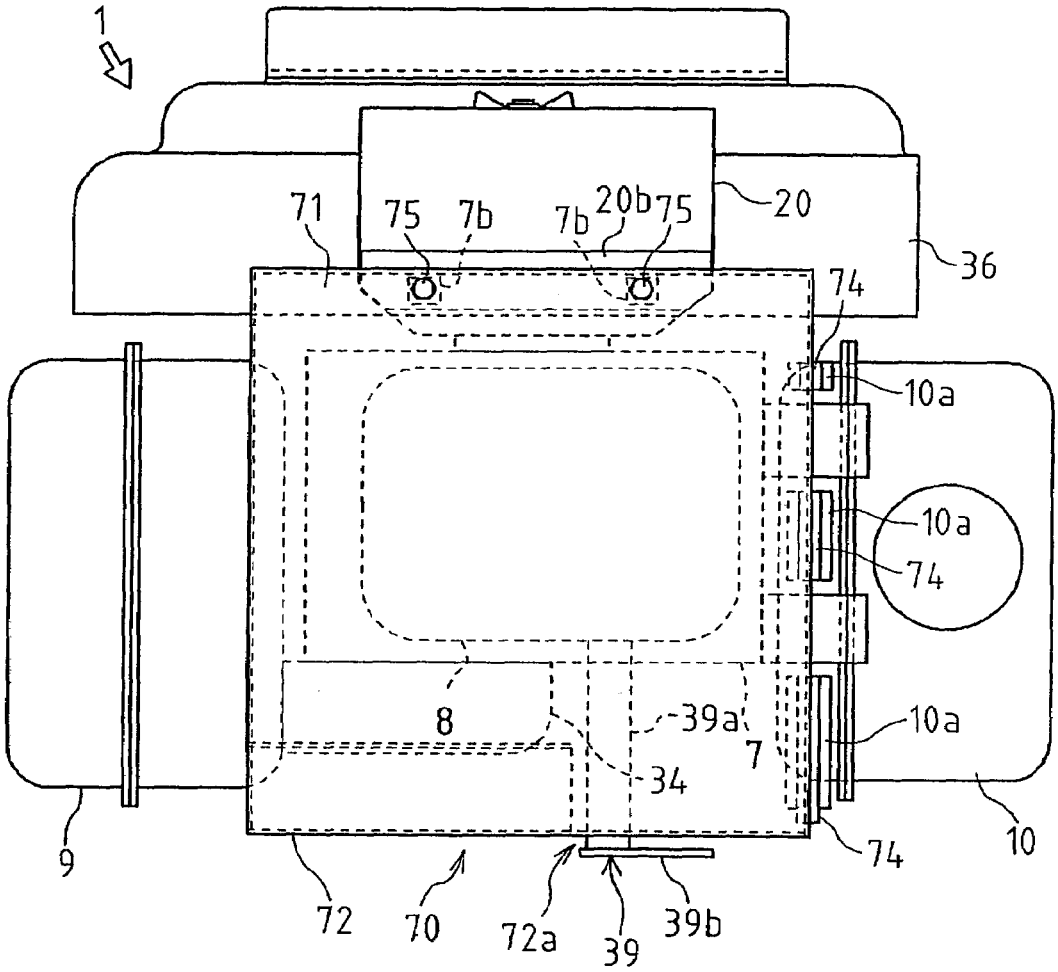
FIG. 12 is a plan view of the engine attached thereon with the cover according to the second embodiment.

Furthermore, as shown in FIG. 12, fuel tank 10 is also formed on the front side thereof with another indented support portion 10*a* projecting from the housing portion. Side cover 72 is squarely bent and extended rearward at right and left edge portions thereof. The rearward extending edge portion of side cover 72 on the fuel tank 10 side corresponds to forwardly opened indented support portion 10*a*. In this way, cover 70 is attached onto fuel tank 10 by pressing cover 70 into engine 1 from the upper front side thereof.

Next, description will be given of a supporting structure for cover 70 by the housing portion of air cleaner 20.

As shown in FIG. 10 and FIG. 12, air cleaner 20 is formed on a top surface of the housing portion thereof with a projecting attachment portion 20*b* for attachment of cover 70. Attachment portion 20*b* is formed thereon with bolt holes extending downward from the top surface thereof. As shown in FIG. 13, top cover 71 is formed with insertion holes 71*a* and 71*a* so as to overlap the bolt holes formed on attachment portion 20*b* in a plan view in the state that cover 70 is attached on engine 1.

Bolts 75 are screwed into the respective bolt holes of attachment portion 20*b* through insertion hole 71*a* of top cover 71 and rubber cushion 76 as an interposal member, thereby supporting cover 70 onto air cleaner 20. Here, rubber cushion 76 is also formed thereon with insertion holes for inserting bolts 75.

Next, description will be given of a supporting structure for cover 70 by cylinder block 2.

As shown in FIG. 11, cylinder block 2 is formed on a front surface thereof with a projecting attachment portion 2*d* for attachment of cover 70. Attachment portion 2*d* is formed with bolt holes extending rearward from the front surface thereof. As shown in FIG. 13, side cover 72 of cover 70 is formed with insertion holes 72*b* and 72*b* so as to overlap the bolt holes formed on attachment portion 2*d* of cylinder block 2 in a plan view in the state that cover 70 is attached on engine 1.

Bolts 75 are screwed into the respective bolt holes on attachment portion 2*d* through insertion hole 72*b* on side cover 72 and rubber cushion 76 as an interposal member, thereby firmly supporting side cover 72 onto cylinder block 2.

In this way, cover 70 is supported on the housing portion of fuel tank 10 and air cleaner 20 and the outer surface of cylinder block 2.

Due to the above structure, cover 70 can be vibratory-isolatingly supported on the main body of the engine, thereby improving sound insulation to reduce noise.

Furthermore, in a configuration where fan 35 is arranged behind cylinder block 2, as detailed later, cooling air from fan 35 can be guided by cover 70 so as to be led into a space between cylinder head 7 and cover 70, thereby improving the efficiency of cooling cylinder head 7, bonnet cover 8, etc.

In addition, even in a configuration where exhaust pipe 34 is arranged in the exposed side of cylinder head 7, that is, in the side where devices such as muffler 9 are not disposed, cover 70 covers exhaust pipe 34 so that users are prevented from accidentally touching exhaust pipe 34. Furthermore, cover 70 can be used as a means for covering a base portion of muffler 9 (a joint between muffler 9 and exhaust pipe 34).

Here, cover 70 on the housing portions of the above-mentioned devices does not always require rubber cushions 74 and 76. Alternatively, cover 70 may be fixed onto engine 1 by means of direct bolting, for example, without any vibration-absorbing interposal member.

Now, detailed description will be given of the supporting structure of cover 70 focusing on vibration-reducing mechanism.

In this embodiment, cover 70 is made up of a bending-pressed metal plate member. For this reason, cover 70 is vibratory-isolatingly supported on the main body of engine 1 so as to be prevented from resonating with engine 1 to cause metallic noise when engine 1 is driven.

Here, in this embodiment, cover 70 is made up of a metallic plate member and vibratory-isolatingly supported on the main body of engine 1 via a rubber cushion 74 which is an elastic member. However, this configuration is not limitative. Alternatively, a cover itself may be made up of an elastic member such as a resinous member, for example, to have vibration-absorbing effect. Any other configuration is possible as long as the cover is attachable on engine 1.

Now, description will be given of a configuration for controlling decompressor 39 in the state that cover 70 is attached on engine 1.

Side cover 72 of cover 70 is formed on a top surface thereof with an insertion hole 72*a* for inserting control shaft 39*a* of decompressor 39. Control shaft 39*a* projects to the outside from insertion hole 72*a*. On the outer end of control shaft 39*a* is fixed decompressor lever 39*b*. The diameter of insertion hole 72*a* substantially corresponds to the outer diameter of control shaft 39*a*. Therefore, an exposed area of cylinder head 7 in insertion hole 72*a* is negligibly small.

In this way, decompressor lever 39*b* is arranged outside side cover 72 to be operable for controlling decompressor 39 while keeping the silent condition that cover 70 is attached on engine 1.

Furthermore, the operating portion of decompressor 39 is disposed below the top surface of cover 70. In the present embodiment, decompressor lever 39*b* serves as the above-mentioned operating portion of decompressor 39, and does not jut out above cover 70, thereby keeping good appearance of the top surface of engine 1.

Now, description will be given of cooling structure of cylinder block 2.

As shown in FIG. 11, fan case 36 containing fan 35 is disposed on one side (rear side) of cylinder block 2. Cooling air from fan 35 is guided by fan case 36 to be sent out to the other side (the opposite side to the one side, namely, the front side) and the upper side of cylinder block 2.

The cooling air cools the rear surface of cylinder head 7, and further cools the side surfaces of cylinder block 2, cylinder head 7, etc. while passing through cylinder block 2 and through a space between cylinder head 7 and devices such as muffler 9 and fuel tank 10.

Furthermore, as shown in FIG. 10 and FIG. 12, side cover 72 of cover 70 is extended to the front side of cylinder block 2 so as to cover the front side (the opposite side to fan 35) of cylinder block 2.

As a result, cover 70, which is arranged to cover the top side and the one side (front side) of cylinder block 2, functions as an air guiding plate to lead cooling air from fan 35 to the opposite side of cylinder block 2 to fan 35.

As shown in FIG. 11, cooling air from fan 35 is sent out from a top of fan case 36 and flows upward through a space between cylinder head 7 and air cleaner 20. Then, the cooling air flows forward through a space between top cover 71 and bonnet cover 8, and, finally, it flows downward through a space between side cover 72 and cylinder head 7.

In this way, the cooling air from fan 35 is guided by cover 70 to cool cylinder head 7, bonnet cover 8, etc. In addition, the cooling air also flows through a space between muffler 9, fuel tank 10 and cylinder block 2 to cool cylinder block 2.

Next, description will be given of an effect of the layout of cover 70 relative to the devices including air cleaner 20 provided on engine 1.

As described above, muffler 9 and fuel tank 10 are disposed on the left and right sides of cylinder head 7, respectively. Air cleaner 20 is disposed on the rear side of cylinder head 7 (one of the sides where neither muffler 9 nor fuel tank 10 are disposed).

Further, top cover 70, which is formed to have an approximate inverse L shape in a section view, comprises top cover 71 and side cover 72. Side cover 72 is disposed on the opposite side of cylinder head 7 to air cleaner 20 (that is, on the front side of cylinder head 7).

Therefore, the front, rear, left and right sides of cylinder head 7 are covered by side cover 72, air cleaner 20, fuel tank 10 and muffler 9, respectively, and the top of cylinder head 7 is covered by top cover 71. As a result, the top and the four sides of cylinder head 7, bonnet cover 8, etc. are all covered, thereby improving sound insulation to reduce noise generated from cylinder head 7, bonnet cover 8, etc.

In addition, by entirely covering cylinder head 7, users are prevented from accidentally touching exhaust pipe 34, and the appearance of engine 1 is improved.

INDUSTRIAL APPLICABILITY

As described above, the engine cover structure according to the present invention has the merit of improving sound insulation so that noise generated from the cylinder head is reduced, and also has the merit that the cylinder head and the exhaust pipe are cooled by cooling air from the fan.

What is claimed is:

1. An engine cover structure for an engine whose cylinder head is covered at three of front, rear, right and left sides thereof by a fuel tank, an air cleaner and a muffler, respectively, comprising:

a top cover which covers a top side of said cylinder head; and a side cover which covers the remaining exposed one side of said cylinder head, wherein said side cover is disposed on a side of said cylinder head opposite to said air cleaner.

2. An engine cover structure according to claim 1, wherein said side cover and said top cover are interally formed.

3. An engine cover structure according to claim 1, wherein said side cover is bent corresponding to a shape of an exhaust pipe disposed on a side surface of said cylinder head.

4. An engine cover structure according to claim 1, wherein a fan is disposed on one side of a cylinder block beneath said cylinder head, and wherein said side cover is extended to cover another side of said cylinder block opposite to the fan.

5. An engine cover structure according to claim 1, wherein said side cover has an opening.

6. An engine cover structure for an engine whose cylinder head is covered at three of front, rear, right and left sides thereof by a fuel tank, an air cleaner and a muffler, respectively comprising:

a top cover which covers a top side of said cylinder head; and a side cover which covers the remaining exposed one side of said cylinder head, wherein said side cover has a notched upper edge portion fixed on a side surface of said top cover.

7. An engine cover structure according to claim 6, wherein said side cover is bent corresponding to a shape of an exhaust pipe disposed on a side surface of said cylinder head.

8. An engine cover structure according to claim 6, wherein a fan is disposed on one side of a cylinder block beneath said cylinder head, and wherein said side cover is extended to cover another side of said cylinder block opposite to the fan.

9. An engine cover structure according to claim 6, wherein said side cover has an opening.

10. An engine cover structure for an engine whose cylinder head is covered at three of front, rear, right and left sides thereof by a fuel tank, an air cleaner and a muffler, respectively, comprising:

a top cover which covers a top side of said cylinder head; and a side cover which covers the remaining exposed one side of said cylinder head, wherein said side cover has a lower edge portion whose at least one side is perpendicularly bent to form a projection inserted into a slit formed in a main body of said engine so as to attach said side cover to said main body.

11. An engine cover structure according to claim 10, wherein said top cover and said side cover are integrally formed.

12. An engine cover structure according to claim 10, wherein said side cover is bent corresponding to a shape of an exhaust pipe disposed on a side surface of said cylinder head.

13. An engine cover structure according to claim 10, wherein a fan is disposed on one side of a cylinder block beneath said cylinder head, and wherein said side cover is extended to cover another side of said cylinder block opposite to the fan.

14. An engine cover structure according to claim 10, wherein said side cover has an opening.

15. An engine cover structure for an engine whose cylinder head is covered at three of front, rear, right and left sides thereof by a fuel tank, an air cleaner and a muffler, respectively, comprising:

a side cover which covers the remaining exposed one side of said cylinder head; and a top cover which covers a top side of said cylinder head, wherein said top cover is formed on a top surface thereof with a hole for inserting a lifting member and a hole for feeding startup assisting material.

16. An engine cover structure according to claim 15, wherein said top cover is formed on a top surface thereof with an attachment hole used for attaching said top cover onto said engine, wherein the periphery of said attachment hole is formed like a funnel, and wherein a slit is formed on an inner side surface of said attachment hole.

17. An engine cover structure for an engine whose cylinder head is covered at three of front, rear, right and left sides thereof by a fuel tank, an air cleaner and a muffler, respectively, comprising:

a top cover which covers a top side of said cylinder head;

a side coyer which covers the remaining exposed one side of said cylinder head; and an operating portion of a decompressor disposed below a top surface of said top cover.

18. The engine cover structure according to claim 17, wherein a decompressor lever serving as said operating portion of said decompressor is inserted through a hole formed in said side cover and projected to the outside of said side cover.

19. An engine cover structure for an engine whose cylinder head is covered at three of front, rear, right and left sides thereof by a fuel tank, an air cleaner and a muffler, respectively, comprising:

a top cover which covers a top side of said cylinder head;

a side cover which covers the remaining exposed one side of said cylinder head; and a cooling air guide for guiding cooling air to a space between a bonnet cover and said top cover disposed over said cylinder head, wherein the cooling air guide is formed in a cylinder head side of body of said air cleaner.

20. The engine cover structure according to claim 19, wherein said cooling air guide is integrally formed on a partition wall formed in the cylinder head side of said body of said air cleaner.

* * * * *

UNITED STATES PATENT AND TRADEMARK OFFICE

CERTIFICATE OF CORRECTION

PATENT NO. : 7,191,753 B2
APPLICATION NO. : 11/219912
DATED : March 20, 2007
INVENTOR(S) : Sagara et al.

It is certified that error appears in the above-identified patent and that said Letters Patent is hereby corrected as shown below:

In claim 2, column 14, line 2, the word “interally” should be --integrally--.
In claim 17, column 15, line 16, the word “coyer” should be --cover--.

Signed and Sealed this

Twenty-third Day of September, 2008

JON W. DUDAS
*Director of the United States Patent and Trademark Office*